US005531432A

United States Patent [19]

Sardella

[11] Patent Number: 5,531,432

[45] Date of Patent: Jul. 2, 1996

[54] METHOD AND APPARATUS FOR FEEDING SHEETS

[76] Inventor: Louis M. Sardella, 518 Kinsale Rd., Timonium, Md. 21093

[21] Appl. No.: 260,808

[22] Filed: Jun. 16, 1994

Related U.S. Application Data

[63] Continuation-in-part of Ser. No. 662,034, Feb. 28, 1991, which is a continuation of Ser. No. 257,063, Oct. 13, 1988, Pat. No. 5,184,811.

[51] Int. Cl.[6] ..... B65H 5/00

[52] U.S. Cl. ..... 271/10.01; 271/12

[58] Field of Search ..... 271/10–12, 117, 271/118, 112, 274, 10.01; 198/626.1, 626.4

[56] References Cited

U.S. PATENT DOCUMENTS

| | | | |
|---|---|---|---|
| 4,610,444 | 9/1986 | Land et al. | 271/12 |
| 4,681,311 | 7/1987 | Sardella | 271/11 |
| 5,183,251 | 2/1993 | Sardella | 271/276 |
| 5,184,811 | 2/1993 | Sardella | 271/10 |

FOREIGN PATENT DOCUMENTS

| | | | |
|---|---|---|---|
| 2219354 | 10/1973 | Germany | 198/626.1 |
| 659513 | 10/1951 | United Kingdom | 198/626.1 |

*Primary Examiner*—David H. Bollinger
*Attorney, Agent, or Firm*—William E. Mouzavires

[57] ABSTRACT

A feeder for feeding corrugated blanks in a box finishing machine including overlying and underlying endless timing belts sandwiching the blanks to feed them. The belts are spaced from each other to form a first gap at rectilinearly moving sections located between opposite end pulleys of the belts. The gap between the belts at the inlet and outlet pulleys is greater than the first gap whereby blanks are engaged and fed by the belt sections as they move rectilinearly between the opposite end pulleys. One of the belts is urged into yieldable engagement with the blank by a pressure mechanism including a floating pressure plate engaging the belt and a spring engaging the pressure plate. An extended stroke feeder is used to feed blanks to the endless belts at a constant velocity matched to the velocity of the belts.

29 Claims, 4 Drawing Sheets

METHOD AND APPARATUS FOR FEEDING SHEETS

RELATED APPLICATION

This application is a continuation-in-part of U.S. application Ser. No. 07/662,034, filed Feb. 28, 1991 and entitled "Method And Apparatus For Feeding Sheets" which is a continuation of U.S. application Ser. No. 07/257,063, filed Oct. 13, 1988, now U.S. Pat. No. 5,184,811.

BACKGROUND OF INVENTION

The present invention generally relates to conveying or feeding sheets or sheet material such as, for example, corrugated blanks, in a box finishing machine. In such machine it is important that the sheets are fed in synchronism with the operations performed at the stations along the machine, such operations being, for example, printing, slotting and scoring, folding and gluing. In the box finishing machine art, synchronous feeding of the sheets relative to the cycle of operation at the various stations along the machine is often referred to as "register feeding" or "feeding in register". In order for the operations such as printing, slotting, scoring, folding and gluing to be performed at the right locations on the sheet, it is obvious that the sheet must arrive at the stations at precisely the right times.

In a box finishing machine, for example, corrugated blanks are fed from a vertical hopper one by one from beneath the hopper by means of a first feeder which sequentially transports the blanks from the bottom of the hopper to a second feeder positioned at the beginning or inlet of the box finishing machine. In conventional machines, the second feeder may be nip rolls or feed rolls. In the corrugated box art, the second feeder could be termed a transfer conveyor, pull conveyor or feeder conveyor.

Feed rolls or nip rolls include an underlying roll typically having a knurled steel surface and an upper roll having for example a steel core and a grooved rubber surface layer. The sheet or corrugated blank being fed is of course gripped between the rolls and fed along the path of the finishing machine. The area of contact with the corrugated blank is limited to that which occurs at the nip of the feed rolls. Consequently, it is necessary to provide sufficient force at the nip to ensure proper gripping of the corrugated blank. The result is that the blank being fed is susceptible to crushing or deformation, and furthermore it will not be gripped with sufficient force if the gap between the rollers is not set to precise dimension. Moreover, the precise setting of the gap is not predictable with such rolls. In addition, the deformation of the flexible or deformable feed roll surfaces causes variation in surface speed resulting in loss of register and roll wear.

More recently a vacuum type conveyor has been used in which for example a wheel or belt conveyor is contained in a vacuum box so that the vacuum holds the sheet or blank on the belt or wheels of the conveyor. However, the problem with this method is that if the vacuum in the vacuum box is constant, large air losses occur in the spaces between successive sheets or blanks being fed thus requiring a very large volume of air movement and vacuum source, not to mention the noise and power requirements that attend such installations.

In an attempt to overcome this problem, application of the vacuum is timed with the flow of the sheets or blanks. However this imposes a limitation on the speed of the feeding process and in turn production while further requiring complicated and expensive mechanisms in order to effect the periodic application of vacuum in timed relationship with the flow of sheets or blanks. In addition, with a vacuum system, the amount of vacuum that can be applied to the sheets is limited and thus loss of register can result.

Another attempt to improve feeding in this art is disclosed in my U.S. Pat. No. 5,183,251. While the conveyor disclosed there has advantages over nip rolls and vacuum conveyor, it involves the handling of positive air flow to hold the blank on the conveyor belt. The flow of air can result in problems with dust in downstream operation of printing.

OBJECTS OF THE PRESENT INVENTION

One of the objects of the present invention is to provide novel and improved method and apparatus for feeding sheets or blanks including without limitation corrugated board in a box finishing machine while at the same time reducing, if not eliminating, the problems mentioned above attendant to conventional feeder systems of the prior art. Although the present invention is particularly suitable for use in feeding sheets or blanks in a box finishing machine, it will be understood that the present invention may have equal applicability for feeding sheets in other environments and for other purposes.

Another object of the present invention is to provide novel and improved method and apparatus for feeding corrugated blanks in register in a box finishing machine. Included herein are such method and apparatus which may use to advantage the EXTEND-O-FEEDtm feeder presently used in industry to feed corrugated blanks from a hopper to the inlet of a box finishing machine; such a feeder being disclosed in U.S. Pat. No. 5,184,811.

A further object of the present invention is to provide novel and improved method and apparatus for feeding sheets or corrugated boards while minimizing if not avoiding crushing of the sheets or boards. Included herein are such methods and apparatus which engage the boards over a relatively large area requiring less mechanical pressure (p.s.i.) than is required with the use of conventional feed or nip rolls.

Another object of the present invention is to provide a feeder for a box finishing machine whose transport speed can be accurately determined and maintained to ensure register feeding, A still further object of the present invention is to provide novel method and apparatus for feeding corrugated board and which will automatically adjust to correct operator error or to variations in the contour of the board to make certain the board is gripped with proper force for feeding but without crushing the board.

A further object of the present invention is to provide a novel and improved sheet feeder which will attain the above objects and yet may be incorporated into a conventional box finishing machine.

A still further object is to provide method and apparatus for feeding corrugated board through the use of mechanical pressure thereby avoiding the above-noted problems attendant vacuum feeders.

SUMMARY OF PREFERRED EMBODIMENT OF THE INVENTION

In summary the present invention, in its preferred embodiment, utilizes overlying and underlying endless belts provided by timing belts also known as gear belts or synchronous belts. The belts receive the corrugated board therebetween in "sandwich" fashion. The gap between the belts at locations intermediate their ends when the belts move rectilinearly is less than at their ends where the belts are traveling about the pulleys. The boards are therefore engaged only at their sections which are moving rectilinearly and whose speed can be accurately determined. In the preferred embodiment, a pressure means is provided on at least one of the belts intermediate the ends thereof for applying and distributing pressure to the board throughout a relatively large area limited only by the width and length of the belt between centers of the end pulleys. In addition, the preferred embodiment has a yieldable biasing means preferably a spring engaging a pressure member for urging the belt against the board.

When used in a box finishing machine, it is preferred that an extended stroke feeder such as that disclosed in my parent application identified above be used to deliver boards from the hopper to the endless timing belts. Such a feeder is capable of feeding the board sufficient distance at constant velocity matched to the timing belts to allow the board to be fed at such velocity until it reaches the downstream end of the belt sections which engage the board.

DRAWINGS

Other objects and advantages of the present invention will become apparent from the following more detailed description taken in conjunction with the attached drawings in which.

DETAILED DESCRIPTION

Figure 1:
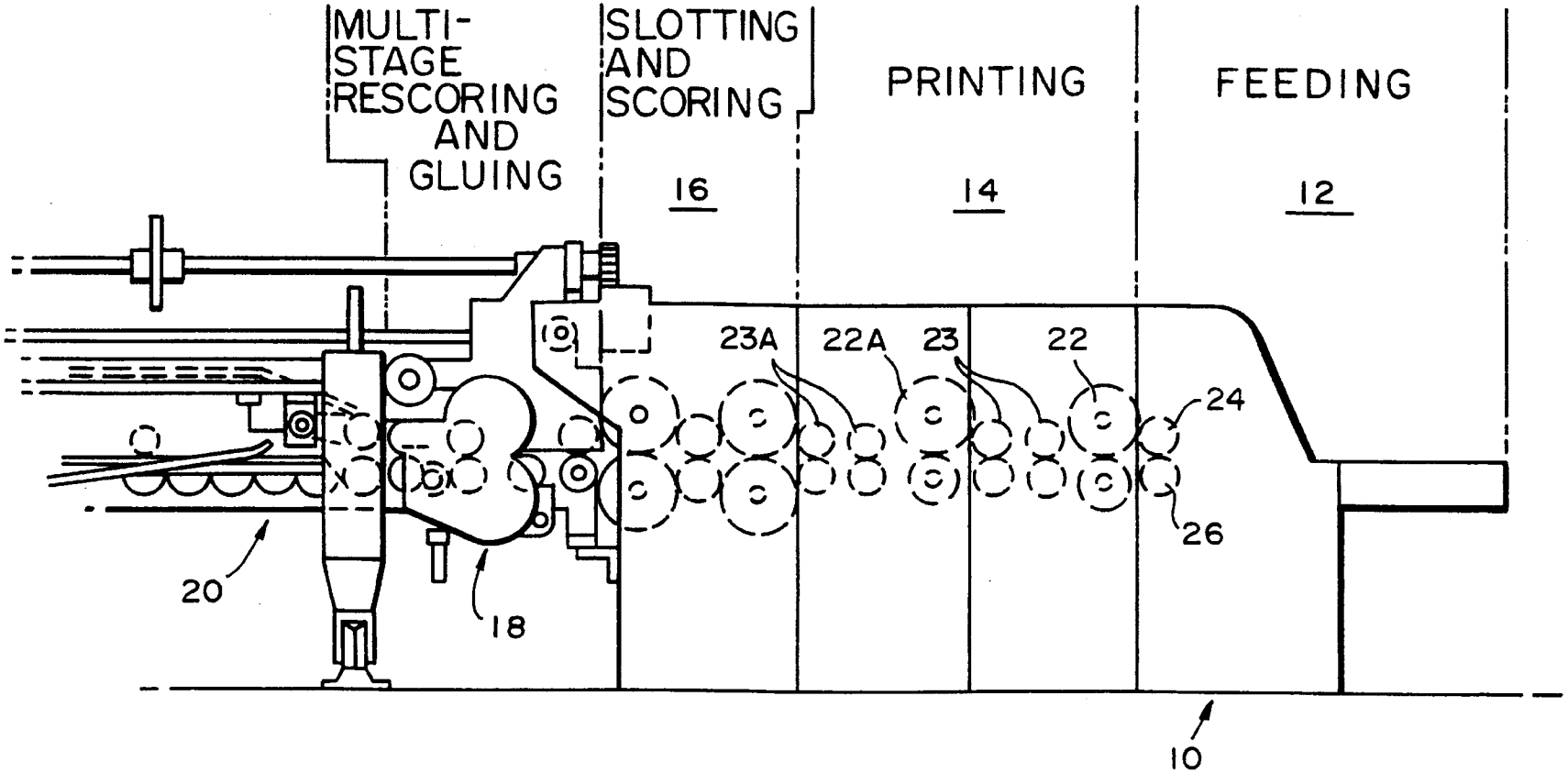
PRIOR ART FIG. 1
FIG. 1 is an elevational view of a box finishing machine of the prior art illustrating the type of machine in which the conveyor system or feeder of the present invention may be applied.
Figure 2:
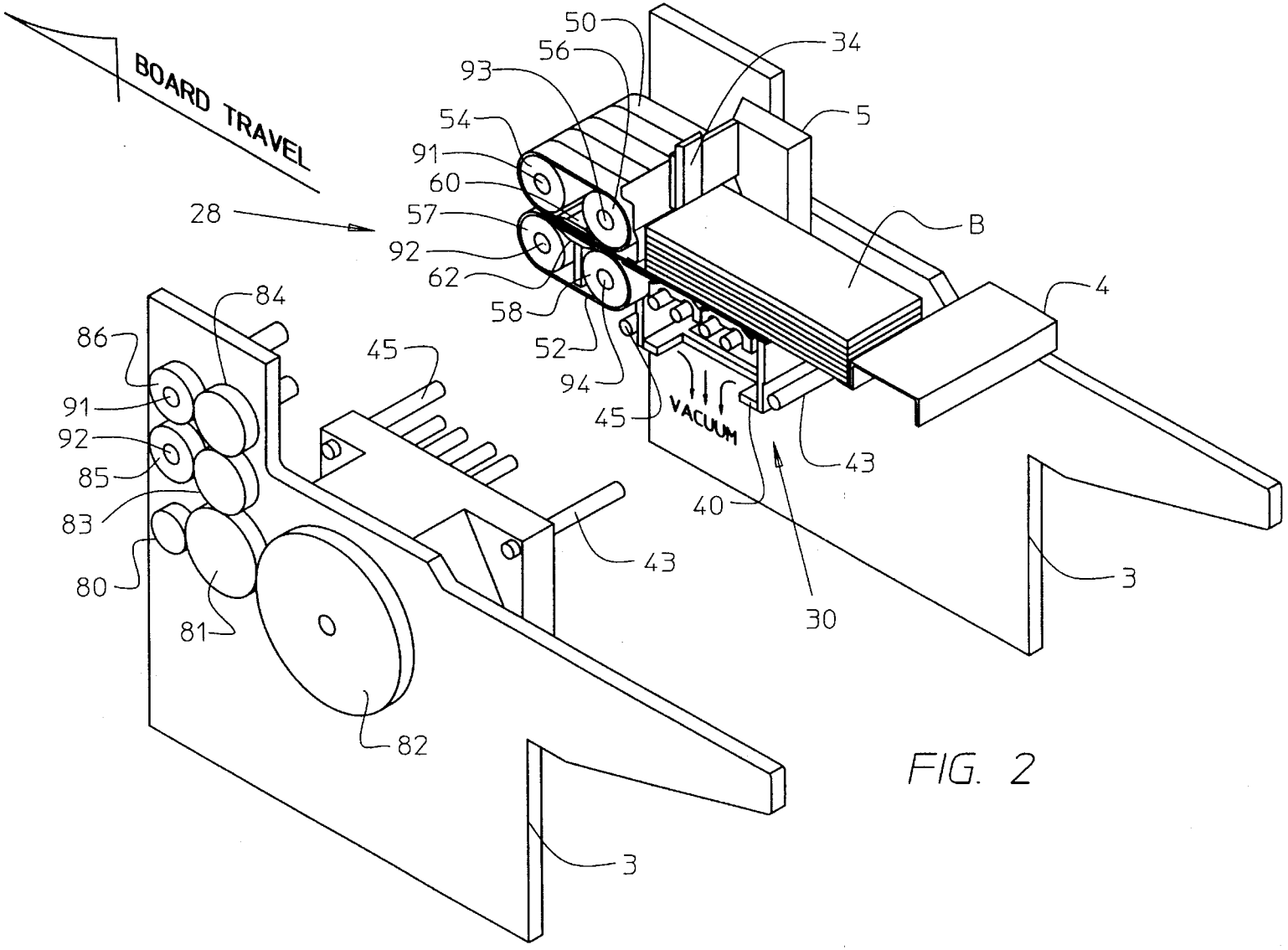
FIG. 2 is a perspective view of the right hand portion of a preferred embodiment of the feeder of the present invention, with the left hand portion cut away along the center line of the machine in the direction of board travel but also showing the drive system.

Referring now to the drawings in detail and initially to FIG. 1 there is shown in schematic form a box finishing machine which typically exists in the prior art. Such machine includes at the inlet end 12, a feeding station where sheets or corrugated boards or blanks are fed from a hopper to a pair of nip rolls or feed rolls 24 and 26 as described above under the section BACKGROUND OF INVENTION. The hopper and the feeder which conveys the blanks from the hopper to the rolls 24 and 26 are not shown in FIG. 1, however, corresponding components are shown in FIG. 2 in connection with the present invention. Feeder generally designated 30 in FIG. 2 is an extended stroke feeder similar to that disclosed in my above-identified copending parent application Ser. No. 07/662,034 and U.S. Pat. No. 5,184,811, the disclosures of which are hereby incorporated by reference into the subject application as part hereof.

Referring to FIG. 1, the sheets are fed by rolls 24 and 26 to a printing station 14 where one or more printing rollers 22 print indicia on the sheet after which the sheet is conveyed by pull rolls 23 to further stations including slotting and scoring station 16 where the sheet is slotted and scored in a predetermined pattern. The sheet is then conveyed to a rescoring and gluing station 18 after which the sheet is conveyed to a folding station 20 where the sheet is folded so that the glue flap along one edge of the sheet is in contact with the opposite edge so as to form a folded paper board, cardboard or corrugated board box.

Figure 3:
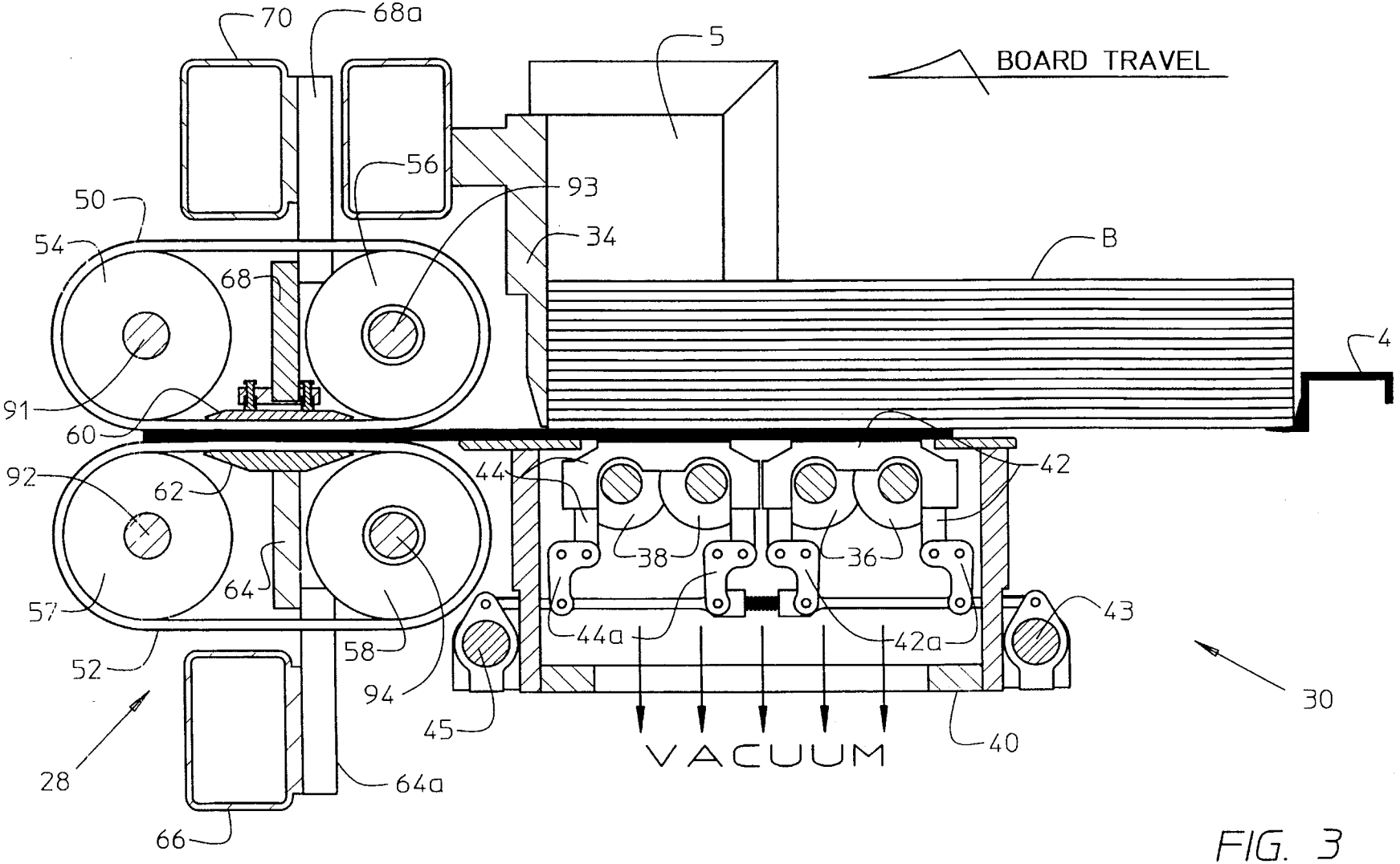
FIG. 3 is a side elevational view of apparatus for feeding corrugated board constituting a preferred embodiment of the invention and with portions shown in cross section.

Referring now to FIGS. 2 and 3, there is shown one preferred embodiment of a conveyor system or feeder generally designated 28 in accordance with the present invention for feeding sheets or corrugated blanks B along a horizontal path in a machine such as a box finishing machine described above. Feeder 28 may be used to replace the feed rolls 24 and 26 in a box finishing machine such as for example described above in FIG. 1.

The corrugated blanks B also referred to in the art as boards are stacked in a hopper from where they are fed one by one under a gate 34 to the feeder 28 by means of an EXTEND-O-FEEDtm conveyor generally designated 30 which has the capability of feeding the blanks B at a constant velocity for an extended stroke or distance sufficient to feed the board B through feed belts of the conveyor 28 to be described further below. FIG. 2 also shows a trail support 4 and a side guide 5 which guides the boards B as they are fed. Feeder 30 includes a plurality of rows of feed rolls 36 and 38 having a high coefficient friction surface which engage the underside of the board to accelerate the board to a velocity matched to the velocity of the drive members or belts of feeder 28 and to maintain that matched velocity for a time sufficient to feed the board through the feeder 28 as will be described. At the conclusion of a feeding cycle, the board B is disengaged first from the feed rolls 36 and then from the feed rolls 38 in sequential fashion by means of vertically reciprocable grate mechanisms 42 and 44. The latter are raised and lowered by means of rocker arms **42*a* and 44*a* actuated by rocker shafts 43 and 45 which in turn are actuated by cams (not shown). For a more detailed description of the actuation of the grates 42 and 44 and the feed rolls 36 and 38, reference may be had to the parent patent application Ser. No. 07/257,063 and/or U.S. Pat. No. 5,184,811, identified above. It should be noted, however, that while the sequential disengagement of the feed rolls 36 and 38 is not disclosed in the aforementioned application and patent, the principle of operation and the components are essentially the same. In the preferred embodiment shown in FIG. 2, the sequential disengagement of the boards by the feed rolls 36 and 38 allows shorter boards to be utilized without effecting the feeding since the disengagement of feed rolls 36 will prevent them from contacting the board above the board being fed when relatively short boards are being fed. It should be understood that a single grate system as disclosed in my aforementioned U.S. Pat. No. 5,184,811 may be used in place of the multiple grates shown and described herein. FIGS. 2 and 3 also show the vacuum box generally designated 40 in which the feed rolls 36, 38** are located, all as described in the aforementioned parent application and patent.

In accordance with the present invention, the feeder 28 is used to replace the conventional nip rolls, for example, 24 and 26 disclosed in FIG. 1, to receive the boards from feeder 30 and to feed the boards to a station downstream in the box finishing machine, such station could be, for example, 14 shown in FIG. 1 where the blanks are printed with indicia. In the preferred embodiment shown, feeder 28 includes overlying and underlying endless belts generally designated 50 and 52 trained about inlet pulleys 56 and 58 and outlet pulleys 54 and 57, respectively. The inlet pulleys 56, 58 are, of course, at the inlet to the feeder 28 through which the boards B will sequentially pass.

In accordance with one of the features of the present invention, endless belts 50 and 52 are timing belts also referred to as "gear belts" or "synchronous belts". Such belts are characterized in that on their inner surface are formed at intermittent locations, transverse grooves 50*a* and teeth 50*b* throughout the entire endless length of the belts, see FIG. 4 for the grooves 50*a* and teeth 50*b*. The lead and trail pulleys are formed about their entire circumference with grooves and teeth complimentary to the grooves 50*a* and teeth 50*b* of the timing belts, see FIG. 4 where the teeth on the pulley 54 is shown at 54*a* and the grooves at 54*b*. The grooves of the belts, of course, receive the teeth of the pulleys in complementary fashion so that upon rotation of the pulleys, the belts will be driven along an endless path during which the belts angularly move about the pulleys and then rectilinearly between the pulleys as is of course well-known. The belts themselves are formed with an outer surface of a high coefficient of friction material such as for example urethane as are the feed rolls 36, 38 of feeder 30. Typically, the outer layer 50*c*, 52*c* of such belts are formed of softer material, i.e., rubber or soft urethane, than the inner layer 50*d*, 52*d* (see FIG. 4).

Figure 4:
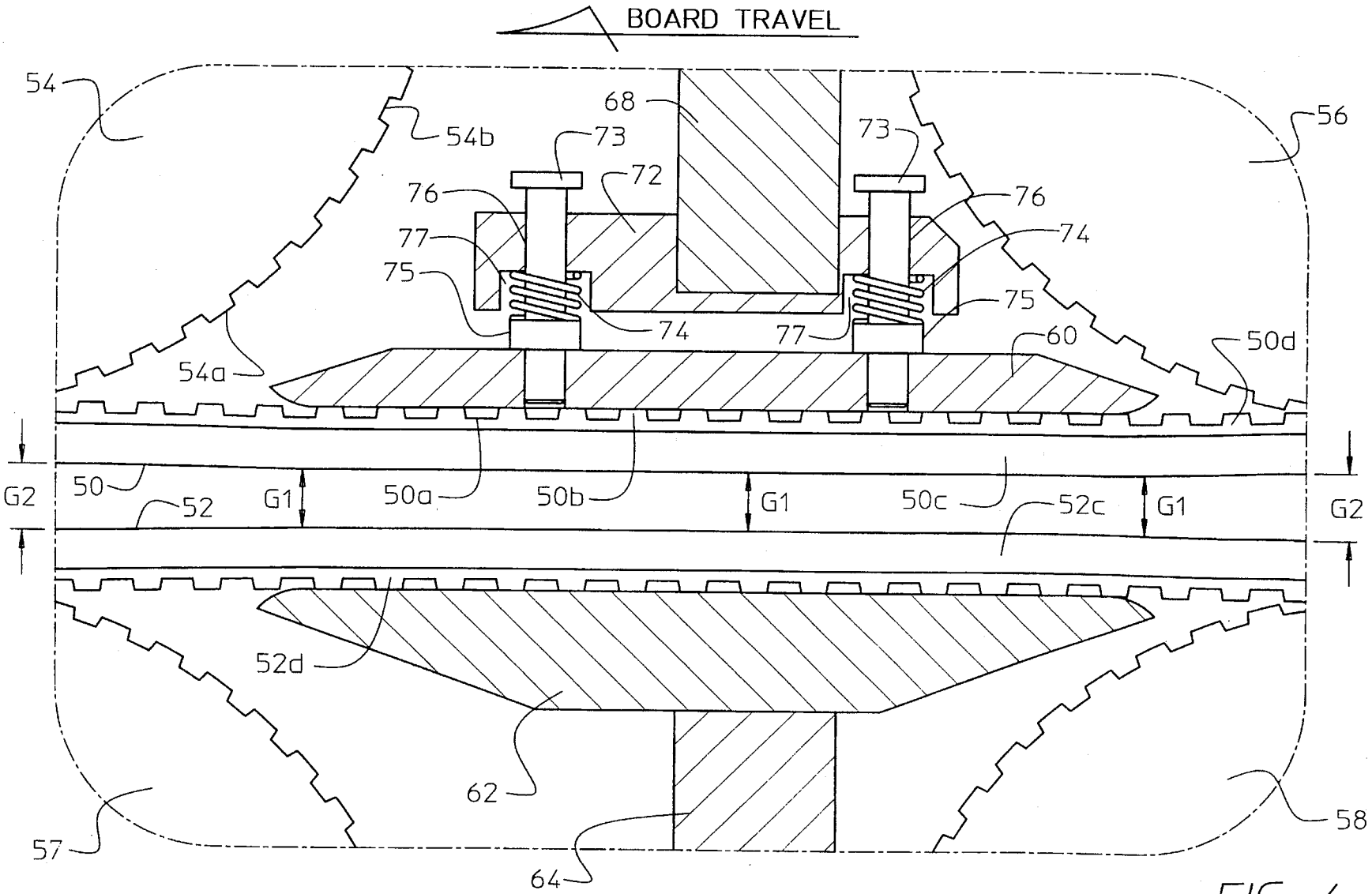
FIG. 4 is an enlarged view of a portion of FIG. 3 showing the area of engagement between the overlying and underlying belts.

Referring to FIGS. 2 and 4, endless belts 50 and 52 are placed in overlying, underlying relationship to form therebetween a gap G1 for receiving and engaging the boards B with the surfaces of the belts 50 and 52 to drive the boards downstream to the next station in the box finishing machine. The vertical dimension of the gap G1 is determined by pressure and/or guide means which in the preferred embodiment include overlying upper and underlying lower members 60 and 62 respectively which will be termed herein "pressure members", located and engaging the inner surfaces of upper belt 50 and lower belt 52 as best shown in FIG. 4. Pressure members 60 and 62 may also be termed "slider beds" as the belts 50 and 52 slide on them during operation. Pressure members 60 and 62 are formed from any suitable material such as, for example, aluminum plates and in the preferred embodiment extend generally coextensively with sections of the belt between the inlet and outlet pulleys. Further, it is preferred that the width of the belts 50 and 52 be generally equal to the width of the inlet and outlet pulleys. Plates 60 and 62 thus provide rectangular pressure distribution surfaces which distribute forces throughout the sections of the belt engaged by them. This allows the pressure on the boards to be reduced since forces are being distributed over a greater area of the belts and consequently crushing of the board is reduced or entirely eliminated.

Pressure members 60 and 62 are set to provide a predetermined gap G1 for engaging and feeding the boards B with the belts 50 and 52 but only at sections intermediate the inlet and outlet pulleys where the belts are moving rectilinearly that is, along straight lines, rather than about the inlet and outlet pulleys. Gap G1 is designed to be less in vertical dimension than the gap G2 formed at the inlet end of feeder 28 between the inlet pulleys 56 and 58 and at the outlet between pulleys 54 and 57. The pressure plates 60 and 62 and the inlet pulleys are arranged so that gap G2 between the inlet pulleys is greater than gap G1 and also slightly greater than the thickness of the boards B being fed. Gap G2 is such that the boards B entering the feeder 28 at gap G2 will not be engaged by belts 50 and 52 and that it is only when the boards enter gap G1 that they will be initially engaged by the overlying and underlying belts 50 and 52. Gap G1 is set so that the boards will be sufficiently engaged by the rectilinearly moving sections of belts 50 and 52 to drive them to the next station in the box finishing machine. It is preferred that such engagement applies a gripping force to the board generally equal to that of the nip rolls 24 and 26 which were used in the prior art and are now replaced by feeder 28. In the preferred form of the present invention, feeder 30 described above is designed to feed the boards B at constant velocity matched to the velocity of belts 50 and 52 for a sufficient distance and until the boards reach the downstream end of the pressure members 60 and 62 where the gap changes from G1 to G2. At that point, disengagement of the boards B by the feed rolls 38 of feeder 30 may be effected. However, the boards B continue to be fed by belts 50 and 52 of feeder 28 to the next station downstream in register. In other embodiments of the invention, the feeder 28 may continue to feed in conjunction with feeder 30 beyond the point where the gap changes from G1 to G2. Moreover, when feeding shorter length boards B, disengagement may occur approximately midway (measured along the direction of travel) of the slider beds 60 and 62 since less pressure is required to continue feeding such boards.

In the preferred embodiment upper pressure member 60 is biased, preferably by spring mechanisms, against its associated belt 50 to apply sufficient pressure to the boards B for feeding. In the specific form shown, the spring mechanisms include a plurality of studs 73 respectively threaded into apertures in pressure member 60 for receiving compression springs 74 as best shown in FIG. 4. Studs 73 extend through passages 76 formed in an anchor plate 72 overlying pressure member 60 and secured to a support 68 such as by screws not shown in FIG. 4. Studs 73 are provided with shoulders 75 for receiving one of the ends of the compression springs 74. The other ends of the springs may engage bottom surfaces or shoulders of recesses 77 formed in anchor plate 72. Instead of compression spring mechanisms as described and shown, other spring or biasing mechanisms such as leaf springs, diaphragms or fluid cylinder mechanisms (not shown) may be employed if desired. In addition, resilient and flexible materials such as foam or rubber may be employed to bias the pressure member 60.

Although the spring mechanisms bias the pressure member 60 to apply predetermined forces to the belt 50 which forces are distributed throughout a large section of the belt between the inlet and outlet pulleys, the springs allow the pressure member 60 to adjust or float to compensate for error in setting the gap G1 or variation in the thickness of the boards B being handled. The strength of the springs 74 are designed accordingly. In the preferred form of the invention, the parts are designed and arranged such that 0.5 p.s.i. is applied to the boards B as they are being fed by the belts at the gap G1. Because feeding of the boards B takes place while the belts are moving rectilinearly, the surface speed on opposite (outside) surfaces of the belts 50 and 52 remains substantially the same thus avoiding feeding of the boards as in conventional endless belt conveyors where the boards are initially engaged at the inlet where the belts are still moving about the lead pulleys and the surface speed of the outer surface of the belts is greater than the speed of the inner surface of the belt. The latter condition makes it difficult if not impossible to control or determine the speed of the boards B with the objective of maintaining precise register-feeding. The present invention uniquely avoids the problem by driving the boards with the belts only while they are moving rectilinearly between the lead and trail pulleys where the speed of the belts is precisely determined and controlled to provide the desired register feeding.

Referring to FIGS. 3 and 4, the lower pressure member 62 in the specific form shown is fixed to a support 64 in any suitable manner such as by screws (not shown). A vertical support column 64 is fixed to support 64*a* and in turn is fixed to a transversely extending structural support tube 66 which, at its opposite ends, is secured to the main frames 3 (see FIG. 2) of the machine. Main frames 3 are vertical plates of suitable metallic material such as steel located on opposite sides of the feeders 28 and 30 as shown in FIG. 2. Support 68 of the upper pressure member 60 is secured to vertical column 68*a* which, in turn, is fixed to a transversely extending structural support tube 70 movably mounted at its opposite ends to main frame plates 3. In the preferred embodiment, structural support tube 70 is adjustable vertically to set the gap G1 before operation. If there is a small error in this setting by the operator, the spring mechanisms 74 will compensate for the error to provide sufficient force and pressure distribution for feeding the boards B.

Referring now to FIGS. 2 in the preferred embodiment, a plurality of upper and lower belts 50 and 52 are provided in tandem about a plurality of inlet and outlet pulleys. Outlet pulleys 54 and 57 are mounted on shafts 91 and 92 suitably journalled within the main support plates 3 or in subassemblies mounted to the latter. Shafts 91 and 92 are driven by gears 86 and 85 mounted to pulley shafts 91 and 92 and respectively driven by gears 86 and 85. The latter gears are driven by 84 and 83 respectively. Gear 83 also drives gear 84 while being driven by an idler gear 81 which also drives the input gear 82 of the planetary transmission system of the feeder 30 described above. Gear 81 is driven by a drive gear 80 which also provides the drive for the printing cylinders 22 shown in FIG. 1.

Although ten upper belts 50 and ten lower belts 52 are employed in tandem in the preferred embodiment, a greater or lessor amount or even a single upper belt and a single lower belt may be employed in other embodiments. Also, in the preferred embodiment the thickness of the outer layer 50*c*, 52*c* of belts 50, 52 is approximately 0.25 inches. Moreover, when handling boards B, gap G1 is approximately the same as the thickness of the board B and gap G2 is approximately 0.030 inches greater.

To summarize an operation of the apparatus of the present invention, boards B are sequentially fed one by one by feed rolls 36, 38 under gate 34 and through gap G2 of conveyor 28. In the preferred embodiment, feed rolls 36 and 38 are accelerated to drive the board from its position at rest in the hopper to a velocity matched to the velocity of the endless belts 50 and 52 of feeder 28. Prior to entry into gap G1, the board reaches the matched velocity which is maintained constant to drive the board B until it reaches the downstream end of the pressure member 60 of feeder 28. At that time, or some time after, grate 44 will be raised to disengage feed rolls 38 from the board. The board B will initially be engaged by belts 50 and 52 when the board initially enters between pressure members 60 and 62. Belts 50 and 52 thereafter will continue engagement with the board B to drive it to the downstream station. During such feeding of the board, the pressure plate 60 will apply a force to the board controlled by the spring mechanisms and the placement of pressure member 60 and underlying pressure member 62. The force will be distributed over a large section of the upper belt 50 in view of the generally coextensive dimension of the pressure member 60 relative to the belts 50. In addition, spring mechanisms 74 will compensate for error in setting the gap G1 or variations in the thickness of board B. The above cycle of board feeding is, of course, repeated to continuously feed the boards B from the hopper.

It will be seen that the present invention provides a unique method and apparatus which enables utilization of endless belts for feeding corrugated board in a box finishing machine in precise register and at the same time, without crushing the board. The timing belts employed by the present invention and the associated gear and drive mechanisms are obtained from commercially available materials. Moreover, the present invention takes advantage of the extended feeding of such feeders such as the EXTEND-O-FEEDtm brand feeder which has the capability of extended feeding of board at a constant velocity matched to the velocity of the box finishing machine components.

Although a preferred method and apparatus of the present invention have been shown and described above, it will be understood that the invention should not be limited to the specific apparatus shown and described but rather will have applicability elsewhere and therefore the scope of the invention is defined in the appended claims.

I claim:

1. In combination with a box finishing machine having at least one station where an operation is performed on corrugated blanks; a first feeder for feeding corrugated blanks towards the station, comprising in combination; overlying and underlying endless timing belts trained about inlet and outlet pulleys for receiving blanks between the belts and feeding the blanks towards said station, said belts being spaced from each other to form a first gap at rectilinearly moving sections located between the inlet and outlet pulleys, and being spaced from each other at the inlet and outlet pulleys to form a second gap which is greater than said first gap whereby blanks enter said second gap at the inlet pulleys without being driven by said belts and are engaged and driven by said rectilinearly moving belt sections at said first gap and fed toward the outlet pulleys, and a second feeder located upstream of said first feeder for feeding blanks to said first feeder, said second feeder being located and having means for driving a blank through said second gap at the inlet pulleys and into said first gap at a constant velocity matched to the velocity of said belts, and wherein said inlet pulleys have axes of rotation and wherein said second gap is located along a line interconnecting said axes of the inlet pulleys.

2. The combination defined in claim 1 further including means urging one of said belt sections towards the other to engage blanks for feeding the blanks in a direction towards the outlet pulleys.

3. The combination defined in claim 2 wherein said means urging one of said belt sections includes spring means urging said one belt section towards the other.

4. The combination defined in claim 3 wherein said means urging one of said belt sections includes a pressure member engaging said one belt section and said spring engages said pressure member.

5. The combination defined in claim 4 wherein said pressure member is generally coextensive with the width and a substantial length of said one belt section for distributing pressure throughout said one belt section.

6. The combination defined in claim 1 further including a pressure member urging said one belt section towards the other to engage blanks for feeding the blanks in a direction towards the outlet pulleys.

7. The combination defined in claim 6 wherein said pressure member is generally coextensive with the width and a substantial length of said one belt section for distributing pressure throughout said one belt section.

8. The combination defined in claim 6 wherein said second feeder has means for driving a blank to a downstream end of the pressure member.

9. The combination defined in claim 1 wherein said first gap is approximately equal to the thickness of the blanks inches and the second gap is preferably at least 0.010 inches greater than said first gap and most preferably 0.030 inches or more greater than the first gap.

10. The combination defined in claim 9 wherein the belts each include an outer layer of flexible, resilient material having a high coefficient of friction surface engageable with the blanks, and having a thickness of preferably between 0.05 and 0.75 inches and most preferably 0.25 inches.

11. The combination defined in claim 1 wherein said first gap is dimensioned such that the blank is subjected to a pressure of preferably between 0.1 and 4.0 p.s.i. and most preferably 0.5 p.s.i.

12. In combination with a box finishing machine having at least one station where an operation is performed on corrugated blanks; a first feeder for feeding corrugated blanks towards the station, comprising in combination; overlying and underlying endless belts trained about inlet and outlet pulleys for receiving blanks between the belts and feeding the blanks towards said station, said belts being spaced from each other to form a first gap at rectilinearly moving sections located between the inlet and outlet pulleys, and being spaced from each other at inlet and outlet pulleys to form a second gap which is greater than said first gap whereby blanks enter said second gap at the inlet pulleys without being driven by said belts and are initially engaged and driven by both of said belt sections upon entering said first gap, means urging one of said belt sections towards the other to engage blanks for feeding the blanks in a direction towards the outlet pulleys, said means including spring means urging said one belt section towards the other belt section, and a second feeder located upstream of said first feeder for feeding blanks to said first feeder, said second having means for driving a blank through said second gap at the inlet pulley and into said first gap at a location adjacent the outlet pulleys at a constant velocity matched to the velocity of said belts, and wherein said inlet pulleys have axes of rotation and wherein said second gap is located along a line interconnecting said axes of the inlet pulleys.

13. The combination defined in claim 12 wherein said means urging one of said belt sections further includes a pressure member engaging said one belt section and said spring means engages said pressure member, said pressure member being dimensioned generally coextensive with the width and a substantial length of said one belt section.

14. A system for feeding sheets of material such as corrugated board comprising in combination, a first feeder including a pair of endless belt conveyors including endless belts trained about inlet and outlet pulleys for receiving sheets between inner runs of the belts and feeding the sheets towards the outlet pulleys, said inner runs of the belts being spaced from each other to form a first gap at rectilinearly moving sections located between the inlet and outlet pulleys, and being spaced from each other at the inlet pulleys to form a second gap which is greater than said first gap whereby blanks enter said second gap at the inlet pulleys and are engaged and driven by said rectilinearly moving belt sections at said first gap and fed toward the outlet pulleys, and a second feeder located upstream of said first feeder for feeding sheets to said first feeder, said second feeder having means for driving a sheet through said second gap at the inlet pulley and into said first gap at a constant velocity matched to the velocity of said belts, and wherein said inlet pulleys have axes of rotation and wherein said second gap is located along a line interconnecting said axes of the inlet pulleys.

15. The feeder defined in claim 14 further including means urging one of said belt sections towards the other to engage sheets for feeding the sheets in a direction towards the outlet pulleys.

16. The feeder defined in claim 15 wherein said means urging one of said belt section includes spring means urging said one belt section towards the other.

17. The feeder defined in claim 16 wherein said means urging one of said belt section includes a pressure member engaging said one belt section, and said spring means engages said pressure member to urge the pressure member against said one belt section.

18. The feeder defined in claim 17 wherein said belts have a width, and said pressure member is generally coextensive with the width and a substantial length of said one belt section thereby distributing pressure substantially throughout said one belt section.

19. The feeder defined in claim 15 having means for driving a sheet to a downstream end of said means urging one of said belt sections.

20. A method of feeding corrugated blanks in a box finishing machine comprising the steps of: utilizing overlying and underlying endless belt conveyors including timing belts for engaging the blanks at sections of the belts intermediate the ends of the belts where the sections are spaced at a first gap, setting the first gap to be less than a second gap located at the inlet and outlet ends of the conveyor belts such that blanks pass through the inlet and are driven by the belts only at the first gap while the blanks are moving rectilinearly, utilizing a feeder for driving blanks through the inlet of the conveyor belts and into the first gap at a velocity matched to the velocity of said belts, and releasing the blanks from the feeder when the blanks reach a location between the inlet and outlet pulleys and while the blanks are engaged and driven by the belts.

21. The method defined in claim 20 further including the steps of applying pressure through one of the sections of the belts through a distribution member engaging one of said belt sections to distribute pressure substantially throughout said one belt section, and driving the blanks with the feeder until the blanks reach a downstream end of the distribution member.

22. The method defined in claim 21 further including the step of spring biasing said pressure member such that said belt section is automatically adjustable to compensate for variations in the setting of the first gap.

23. A method of feeding corrugated blanks downstream in a box-finishing machine comprising the steps of: feeding a blank downstream with a feeder machine between inner runs of a pair of endless conveyor belts until the blank has at least reached a location intermediate the opposite ends of the belts, engaging the blank with both belts to drive the blank downstream at the same speed at which the feeder machine is feeding the blank, and releasing the blank from the feeder machine when the blank reaches said location and while the belts continue to drive the blank downstream.

24. The method defined in claim 23 including the step of using a pressure-distribution member to exert pressure on one of said belts in a direction toward the other belt to determine the pressure distributed to the blank, and releasing the blank from the feeder machine when it is under pressure from said pressure-distribution member.

25. The method defined in claim 24 wherein said pressure-distribution member is located between opposite upstream and downstream ends of said belts and has a downstream end, and wherein the blank is disengaged from the feeder machine when the blank is at the downstream end of the pressure-distribution member.

26. In combination with a box finishing machine having at least one station where an operation is performed on corrugated blanks; a first feeder for feeding corrugated blanks towards the station and including endless timing belts trained about inlet and outlet pulleys for receiving blanks between inner runs of the belts and feeding the blanks downstream towards said station, said inner runs of the belts being spaced from each other to form a first gap at sections located between the inlet and outlet pulleys and a second gap between the inlet pulleys and greater than said first gap such that the blanks are fed by the belts only while the blanks are moving rectilinearly between said inlet and outlet pulleys, and a second feeder located upstream of said first feeder for feeding blanks to said first feeder, said second feeder having means for driving a blank between said belts at a velocity matched to the velocity of said belts while the belts are also feeding the blank downstream and for disengaging the blank when it reaches a predetermined location between the inlet and outlet pulleys and while the belts are still feeding the blank, and wherein said second gap is located along a line interconnecting rotational axes of the inlet pulleys.

27. The combination defined in claim 26 further including a pressure member urging one belt section towards an opposite belt section to engage blanks for feeding the blanks, and wherein said second feeder has means for disengaging said blank when the blank is located at the pressure member.

28. The combination defined in claim 27 wherein said pressure member has a downstream end and said second feeder has means for disengaging the blank when the blank is at the downstream end of said pressure member.

29. The combination defined in claim 28 wherein said pressure member is generally coextensive with the width and a substantial length of said one belt section for distributing pressure throughout said one belt section.

* * * * *